US009433853B2

(12) United States Patent
Rao

(10) Patent No.: US 9,433,853 B2
(45) Date of Patent: Sep. 6, 2016

(54) BILLIARD TABLE FOR REBOUND TRAINING

(76) Inventor: Tao Rao, Jiangxi (CN)

( * ) Notice: Subject to any disclaimer, the term of this patent is extended or adjusted under 35 U.S.C. 154(b) by 0 days.

(21) Appl. No.: 14/359,101

(22) PCT Filed: May 21, 2012

(86) PCT No.: PCT/CN2012/075790

§ 371 (c)(1),
(2), (4) Date: May 18, 2014

(87) PCT Pub. No.: WO2013/075470

PCT Pub. Date: May 30, 2013

(65) Prior Publication Data

US 2014/0364243 A1 Dec. 11, 2014

(30) Foreign Application Priority Data

Nov. 24, 2011 (CN) ..... 2011 1 0377732

(51) Int. Cl.
*A63D 15/00* (2006.01)

(52) U.S. Cl.
CPC ..... *A63D 15/006* (2013.01); *A63D 15/00* (2013.01)

(58) Field of Classification Search
CPC ..... A63D 15/0006; A63D 15/00; G02B 5/08
USPC ..... 473/1, 2, 4
See application file for complete search history.

(56) References Cited

U.S. PATENT DOCUMENTS

| | | | | |
|---|---|---|---|---|
| 2,537,228 | A * | 1/1951 | Matson | 473/2 |
| 3,463,593 | A * | 8/1969 | Horan | 473/2 |
| 5,873,787 | A * | 2/1999 | Colak | 473/2 |
| 6,132,319 | A * | 10/2000 | Schluter | 473/2 |
| 6,582,316 | B2 * | 6/2003 | Tompert | 473/2 |
| 6,769,992 | B1 * | 8/2004 | Domulevicz et al. | 473/2 |
| 7,147,566 | B2 * | 12/2006 | Keating | 473/2 |
| 7,744,477 | B2 * | 6/2010 | Cook | 473/2 |

* cited by examiner

*Primary Examiner* — Mitra Aryanpour
(74) *Attorney, Agent, or Firm* — Global IP Services; Tianhua Gu

(57) ABSTRACT

A billiard table for rebound training comprises a table top, four corner pockets located at the four corners of the table top, and two side pockets located at the center of the long sides of the table top, wherein a side pocket sight (2) is fixed at the location of a side pocket; a simulation pocket hole (3) is provided at the tail end of the side pocket sight (2); the length of the side pocket sight (2) is equal to the distance between the two side pockets on the table top; and a rotatable corner pocket sight (1) is provided at the location of a corner pocket, a movable marker (4) being provided on the rotatable corner pocket sight (1).

4 Claims, 2 Drawing Sheets

BILLIARD TABLE FOR REBOUND TRAINING

CROSS REFERENCE TO RELATED PATENT APPLICATION

This application claims the priority of Chinese Patent Application No. 201110377732.9 filed on Nov. 24, 2011, entitled "Billiard Table for Rebound Training", which application is incorporated herein by reference.

FIELD OF THE INVENTION

The invention relates to a billiard table and more particularly to a billiard table for rebound training, belonging to sports' equipment filed.

BACKGROUND OF THE INVENTION

In billiard combat, two kinds of bouncing ball techniques are always used, one is once rebounding technique, it means that shoot the target ball to the rail, the target ball is rebounded into the pocket on the other side; other is twice rebounding technique, it means that shoot the cue ball to hit the rail twice, then the cue ball passes around the obstacle ball to hit the target ball. It is difficult for a beginner to grasp these two techniques during a training process. It is better to have a training equipment for helping beginners.

SUMMARY OF THE INVENTION

A billiard table for rebound training, which provides an efficient way to help beginners to grasp the rebounding technique.

The present invention adopts the following technical solutions: a billiard table for rebound training, which includes a table top, four corner pockets located at four corners of said table top respectively, two side pockets are located at centers of long sides of said table top respectively, wherein a side pocket sight device is fixed at a location of said side pocket; the side pocket sight device has a simulation pocket hole located at the end of said side pocket sight; the length of said side pocket sight device is equal to the distance between two side pockets of said table top;

A rotatable corner pocket sight device is provided at the location of a corner pocket, a movable marker for simulation target is provided on said rotatable corner pocket sight device.

One side pocket sight device is provided at one side pocket. Also, two side pocket sight device can be provide at both side pockets respectively.

One rotatable corner pocket sight device is provided at one corner pockets. Also, two or three or four rotatable corner pocket sight devices can be provided at two or three or four corner pockets respectively.

The axial direction of said side pocket sight device is perpendicular to the side edge of the table top, where said side pocket is located.

Said side pocket sight device is fixed to said side pocket and it is perpendicular to the side edge of the table top, where said side pocket is located. Said rotatable corner pocket sight device is rotatable around an axis of said corner pocket.

The advantages of the billiard table for rebound training:

The billiard table of this invention can improve the efficiency of learning rebounding technique for beginner. The billiard table has simple structure and low cost.

DETAILED DESCRIPTION OF THE INVENTION

Example 1

Now, the billiard table for rebound training is described by using the example of once rebounding technique.

Figure 1:
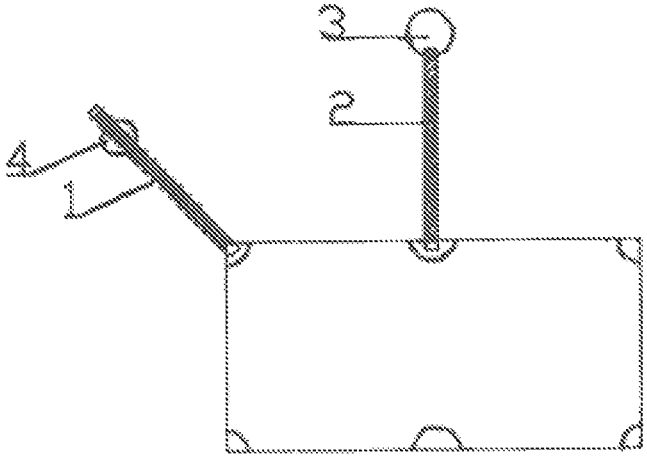
FIG. 1 is a schematic structural view of the billiard table for rebound training.
Figure 2:
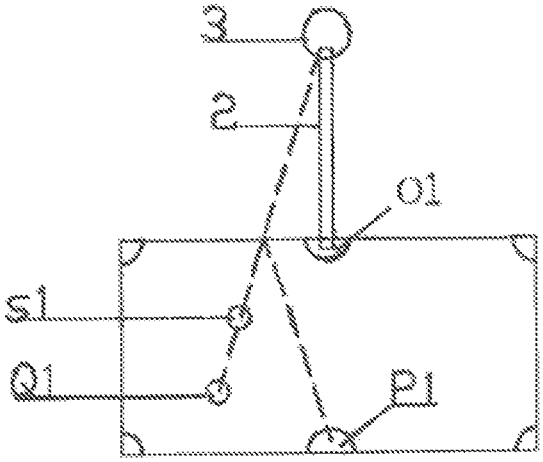
FIG. 2 is a schematic 1 showing the principle of once rebounding technique.

Please refer to FIG. 1 and FIG. 2, a billiard table for rebound training, which includes a table top, four corner pockets located at four corners of said table top respectively, two side pockets located at the centers of long sides of said table top respectively, wherein a side pocket sight device (2) is fixed at the location of said side pocket; a simulation pocket hole (3) is provided at the end of said side pocket sight device (2); the length of said side pocket sight device (2) is equal to the distance between two side pockets.

A rotatable corner pocket sight device (1) is provided at the location of a corner pocket, a movable marker for simulation target (4) is provided on said rotatable corner pocket sight device (1).

FIG. 2 shows the principle of once rebounding technique.

(Q1) is the cue ball, (S1) is the target ball, (3) is a simulation pocket hole, (O1) is a side pocket on one side, (P1) is a side pocket on the opposite side.

The technique is that take the simulation pocket hole (3) as a target, hit the cue ball (Q1) to hit the target ball (S1), then the target ball (S1) is rebounded into the opposite side pocket (P1).

Example 2

Now, the billiard table for rebound training is described by using the example of twice rebounding technique.

Please refer to FIG. 1 and FIG. 2, a billiard table for rebound training, which includes a table top, four corner pockets located at four corners of said table top, two side pockets located at the centers of long sides of said table top, wherein a side pocket sight device (2) is fixed at the location of said side pocket; a simulation pocket hole (3) is provided at the end of said side pocket sight device (2); the length of said side pocket sight device (2) is equal to the distance between two side pockets.

A rotatable corner pocket sight device (1) is provided at the location of a corner pocket, a movable marker for simulation target (4) is provided on said rotatable corner pocket sight device (1).

Figure 3:
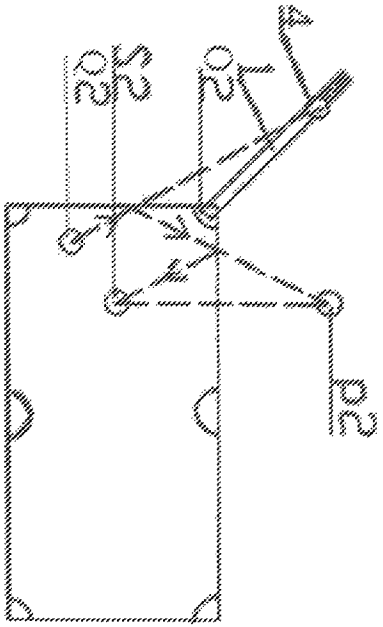
FIG. 3 is a schematic 2 showing the principle of twice rebounding technique.

FIG. 3 is schematic diagram of twice rebounding technique. The cue ball hits the rail twice, then passes around the obstacle ball, then hits the target ball.

(Q2) is the cue ball, (S2) is the target ball, (O2) is corner pocket location. Adjusting the rotatable corner pocket sight device (1) to certain angle till the rotatable corner pocket sight device (1), corner pocket location (O2), target ball (S2) become a straight line. Moving the movable marker for simulation target (4) to a point, the distance from there (4) to (O2) is equal to the distance from (O2) to (S2). Targeting said movable marker for simulation target (4), shoot the cue ball (Q2), through bouncing rail twice, the cue ball (Q2) must hit the target ball (S2).

Geometric principles: because the distance from the movable marker for simulation target (4) to (O2) is equal to the distance from (O2) to (S2), set a point (P2), the (P2) is symmetrical with the movable marker for simulation target regarding the vertical side A of table, and the (P2) is symmetrical with (S2) regarding the parallel side B, therefore the cue ball (Q2) must hit the target ball (S2) by hitting on the rail twice.

The invention claimed is:

1. A billiard table for rebound training comprising:

a table top having four corner pockets and two side pockets;

a side pocket sight device attached to at least one of the two side pockets, wherein the side pocket sight device includes a simulation pocket hole positioned at a lower end thereof, a length of the side pocket sight device equals to a distance between two of the side pockets of said table top; and a rotatable corner pocket sight device attached to at least one of the four corner pockets, wherein the rotatable corner pocket sight device includes a movable marker for simulating a target thereon.

2. The Billiard table for rebound training according to claim 1, wherein the side pocket sight device includes two side pocket sight devices, and wherein each side pocket sight device is attached to one of the two side pockets.

3. The Billiard table for rebound training according to claim 1, wherein the rotatable corner pocket sight device includes a plurality of rotatable corner pocket sight devices, and wherein one of the plurality of side pocket sight devices is attached to at least one of the four corner pockets.

4. The Billiard table for rebound training according to claim 1, wherein an axial direction of the two side pocket sight device is perpendicular to a side of the table top where said side pocket is located.

* * * * *